US006017978A

United States Patent [19]

Chen et al.

[11] Patent Number: 6,017,978

[45] Date of Patent: Jan. 25, 2000

[54] POLYURETHANE FORMING NO-BAKE FOUNDRY BINDERS

[75] Inventors: Chia-hung Chen; Ken K. Chang; Albert Leonard Haugse, all of Dublin; Thomas E. Dando, Sunbury, all of Ohio

[73] Assignee: Ashland Inc., Columbus, Ohio

[21] Appl. No.: 09/032,690

[22] Filed: Feb. 28, 1998

[51] Int. Cl.[7] ..... B22C 1/22

[52] U.S. Cl. ..... 523/143; 523/145

[58] Field of Search ..... 523/143, 145

[56] References Cited

U.S. PATENT DOCUMENTS

| | | | |
|---|---|---|---|
| 3,409,579 | 11/1968 | Robins | 260/30.4 |
| 3,485,797 | 12/1969 | Robins | 260/57 |
| 3,676,392 | 7/1972 | Robins | 525/504 |
| 4,028,271 | 6/1977 | Schaidle et al. | 502/168 |
| 4,268,425 | 5/1981 | Gardikes | 523/143 |
| 4,390,675 | 6/1983 | Gruber | 526/75 |
| 4,495,316 | 1/1985 | Armbruster | 523/145 |
| 4,946,876 | 8/1990 | Carpenter | 523/143 |

*Primary Examiner*—David W. Wu
*Assistant Examiner*—Ling Sui Choi
*Attorney, Agent, or Firm*—David L. Hedden

[57] ABSTRACT

This invention relates to a polyurethane no-bake foundry binder comprising (1) phenolic resin component which comprises (a) a phenolic resin, (b) hydrofluoric acid, and (c) a silane, and (2) an organic polyisocyanate component, and (3) a liquid tertiary amine catalyst component. The binders are used to prepare foundry mixes by mixing the binder with a foundry aggregate. Foundry shapes are prepared with the mixes by the no-bake process and are used to cast metal parts.

16 Claims, No Drawings

POLYURETHANE FORMING NO-BAKE FOUNDRY BINDERS

FIELD OF THE INVENTION

This invention relates to a polyurethane no-bake foundry binder comprising (1) phenolic resin component which comprises (a) a phenolic resin, (b) hydrofluoric acid, and (c) a silane, and (2) an organic polyisocyanate component, and (3) a liquid tertiary amine catalyst component. The binders are used to prepare foundry mixes by mixing the binder with a foundry aggregate. Foundry shapes are prepared with the mixes by the no-bake process and are used to cast metal parts.

BACKGROUND OF THE INVENTION

In the foundry industry, one of the processes used for making metal parts is sand casting. In sand casting, disposable foundry shapes (usually characterized as molds and cores) are made by shaping and curing a foundry mix which is a mixture of sand and an organic or inorganic binder. The binder is used to strengthen the molds and cores.

One of the processes used in sand casting for making molds and cores is the no-bake process. In this process, a foundry aggregate, binder, and liquid curing catalyst are mixed and compacted to produce a cured mold and/or core. In the no-bake process, it is important to formulate a foundry mix which will provide sufficient worktime to allow shaping. Worktime is the time between when mixing begins and when the mixture can no longer be effectively shaped to fill a mold or core.

A binder commonly used in the no-bake fabrication process is a polyurethane binder derived from curing a polyurethane-forming binder composition with a liquid tertiary amine catalyst. The polyurethane-forming binder composition usually consists of a phenolic resin component, a polyisocyanate component, and a catalyst component. Such polyurethane-forming binder compositions, used in the no-bake process, have proven satisfactory for casting such metals as iron or steel which are normally cast at temperatures exceeding about 1370° C. They are also useful in the casting of light-weight metals, such as aluminum, which have melting points of less than 815° C.

Binders are needed which result in higher productivity in core and mold making and metal casting. To accomplish this, the cores and mold produced with the binder must have high tensile strengths when demolded to allow faster demolding and fewer broken molds. Good resistance to humidity also is important because this minimizes breaking under hot and/or humid conditions. These properties must be obtained without shortening the worktime and striptime of the cores and molds. Without adequate worktime and striptime, the operator making the cores and molds cannot be effective.

SUMMARY OF THE INVENTION

This invention relates to a polyurethane forming no-bake foundry binder system comprising as separate parts:

A. phenolic resin component comprising:
- (a) a phenolic resin;
- (b) hydrofluoric acid;
- (c) a silane; and B. an organic polyisocyanate component;

C. a liquid tertiary amine catalyst.

The invention also relates to the use of these foundry binders in a no-bake process to prepare foundry shapes, e.g. cores and molds, and to the use of the foundry shapes to cast metal parts. The addition of a silane and hydrofluoric acid provides no-bake foundry binder which can be used for making cores and molds having greater humidity resistance. Additionally, if higher levels of catalyst are used in the binder, cores and molds can be obtained which have initial (measured 30 minutes after removing the foundry shape from the pattern) tensile strengths of at least 150 psi. Preferably the catalyst is used in amount to result in a worktime of about 3 to 10 minutes and a striptime of about 4 to 12 minutes for the foundry mix. These advantages are obtained without sacrificing other properties such as casting quality.

BEST MODE AND OTHER MODES

The phenolic resole resin component comprises a phenolic resole resin, hydrofluoric acid, a silane, and preferably a solvent. It may also contain various optional ingredients such as adhesion promoters and release agents.

The phenolic resole resin is preferably prepared by reacting an excess of aldehyde with a phenol in the presence of either an alkaline catalyst or a metal catalyst. The phenolic resins are preferably substantially free of water and are organic solvent soluble. The preferred phenolic resins used in the subject binder compositions are well known in the art, and are specifically described in U.S. Pat. No. 3,485,797 which is hereby incorporated by reference. These resins, known as benzylic ether phenolic resole resins are the reaction products of an aldehyde with a phenol. They contain a preponderance of bridges joining the phenolic nuclei of the polymer which are ortho-ortho benzylic ether bridges. They are prepared by reacting an aldehyde and a phenol in a mole ratio of aldehyde to phenol of at least 1:1 in the presence of a metal ion catalyst, preferably a divalent metal ion such as zinc, lead, manganese, copper, tin, magnesium, cobalt, calcium, and barium.

The phenols use to prepare the phenolic resole resins include any one or more of the phenols which have heretofore been employed in the formation of phenolic resins and which are not substituted at either the two ortho-positions or at one ortho-position and the para-position such as unsubstituted positions being necessary for the polymerization reaction. Any one, all, or none of the remaining carbon atoms of the phenol ring can be substituted. The nature of the substituent can vary widely and it is only necessary that the substituent not interfere in the polymerization of the aldehyde with the phenol at the ortho-position and/or para-position. Substituted phenols employed in the formation of the phenolic resins include alkyl-substituted phenols, aryl-substituted phenols, cyclo-alkyl-substituted phenols, aryloxy-substituted phenols, and halogen-substituted phenols, the foregoing substituents containing from 1 to 26 carbon atoms and preferably from 1 to 12 carbon atoms.

Specific examples of suitable phenols include phenol, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, and p-phenoxy phenol. Multiple ring phenols such as bisphenol A are also suitable.

The aldehyde used to react with the phenol has the formula RCHO wherein R is a hydrogen or hydrocarbon radical of 1 to 8 carbon atoms. The aldehydes reacted with the phenol can include any of the aldehydes heretofore employed in the formation of phenolic resins such as formaldehyde, acetaldehyde, propionaldehyde, furfuraldehyde, and benzaldehyde. The most preferred aldehyde is formaldehyde.

The phenolic resin used must be liquid or solvent soluble. The phenolic resin component of the binder composition is generally employed as a solution in an organic solvent. The nature and the effect of the solvent will be more specifically described later. The amount of solvent used should be sufficient to result in a binder composition permitting uniform coating thereof on the aggregate and uniform reaction of the mixture. The specific solvent concentration for the phenolic resins will vary depending on the type of phenolic resins employed and their molecular weight. In general, the solvent concentration will be in the range of up to 80% by weight of the resin solution and preferably in the range of 20% to 80%. It is preferred to keep the viscosity of the phenolic component at less than X on the Gardner-Holdt scale.

The silanes used in the binder composition have the following general formula:

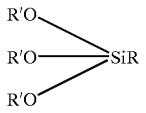

wherein R' is a hydrocarbon radical and preferably an alkyl radical of 1 to 6 carbon atoms and R is an alkyl radical, an alkoxy-substituted alkyl radical, or an alkyl-amine-substituted alkyl radical in which the alkyl groups have from 1 to 6 carbon atoms. The silane is preferably added to the phenolic resin component in amounts of 0.01 to 2 weight percent, preferably 0.1 to 0.5 weight percent based on the weight of the phenolic resin component. Examples of some commercially available silanes are Dow Corning Z6040 and Union Carbide A-187 (gamma glycidoxy propyltrimethoxy silane); Union Carbide A-1100 (gamma aminopropyltriethoxy silane); Union Carbide A-1120 (N-beta(aminoethyl)-gamma-aminopropyltrimethoxy silane); and Union Carbide A-1160 (Ureido-silane).

The hydrofluoric acid is preferably added to the phenolic resin component. The amount of hydrofluoric acid, based upon a 100 percent concentration hydrofluoric acid, added to the phenolic resin component is from 0.01 to 0.5 weight percent, preferably from 0.05 to 0.15 weight percent, based upon the weight percent of the phenolic resin component. Typically, concentration of the hydrofluoric acid preferably is from 1 to 100 weight percent in water.

The polyisocyanate component of the binder typically comprises a polyisocyanate and organic solvent. The polyisocyanate has a functionality of two or more, preferably 2 to 5. It may be aliphatic, cycloaliphatic, aromatic, or a hybrid polyisocyanate. Mixtures of such polyisocyanates may be used. Also, it is contemplated that capped polyisocyanates, prepolymers of polyisocyanates, and quasi prepolymers of polyisocyanates can be used. Optional ingredients such as release agents may also be used in the polyisocyanate hardener component.

Representative examples of polyisocyanates which can be used are aliphatic polyisocyanates such as hexamethylene diisocyanate, alicyclic polyisocyanates such as 4,4'-dicyclohexylmethane diisocyanate, and aromatic polyisocyanates such as 2,4' and 2,6-toluene diisocyanate, diphenylmethane diisocyanate, and dimethyl derivates thereof. Other examples of suitable polyisocyanates are 1,5-naphthalene diisocyanate, triphenylmethane triisocyanate, xylylene diisocyanate, and the methyl derivates thereof, polymethylenepolyphenyl isocyanates, chlorophenylene-2,4-diisocyanate, and the like.

The polyisocyanates are used in sufficient concentrations to cause the curing of the phenolic resin when combined with the curing catalyst. In general the isocyanate ratio of the polyisocyanate to the hydroxyl of the phenolic resin is from 1.25:1 to 1:1.25, preferably about 1:1. Expressed as weight percent, the amount of polyisocyanate used is from 10 to 500 weight percent, preferably 20 to 300 weight percent, based on the weight of the phenolic resin.

The polyisocyanate is used in a liquid form. Solid or viscous polyisocyanate must be used in the form of organic solvent solutions, the solvent generally being present in a range of up to 80 percent by weight of the solution.

Those skilled in the art will know how to select specific solvents for the phenolic resin component and polyisocyanate hardener component. It is known that the difference in the polarity between the polyisocyanate and the phenolic resins restricts the choice of solvents in which both components are compatible. Such compatibility is necessary to achieve complete reaction and curing of the binder compositions of the present invention. Polar solvents of either the protic or aprotic type are good solvents for the phenolic resin, but have limited compatibility with the polyisocyanate. Aromatic solvents, although compatible with the polyisocyanate, are less compatible with the phenolic resins. It is, therefore, preferred to employ combinations of solvents and particularly combinations of aromatic and polar solvents.

Examples of aromatic solvents include xylene and ethylbenzene. The aromatic solvents are preferably a mixture of aromatic solvents that have a boiling point range of 125° C. to 250° C. The polar solvents should not be extremely polar such as to become incompatible with the aromatic solvent. Suitable polar solvents are generally those which have been classified in the art as coupling solvents and include furfural, furfryl alcohol, Cellosolve acetate, butyl Cellosolve, butyl Carbitol, diacetone alcohol, and "Texanol".

In addition, the solvent component can include drying oils such as disclosed in U.S. Pat. No. 4,268,425. Such drying oils include glycerides of fatty acids which contain two or more double bonds whereby oxygen on exposure to air can be absorbed to give peroxides which catalyze the polymerization of the unsaturated portions. Also, esters of ethylenically unsaturated fatty acids such as tall oil esters of polyhydric alcohols such as glycerine or pentaerythritol or monohydric alcohols such as methyl and ethyl alcohols can be employed as the drying oil.

In addition, the binder may include liquid dialkyl esters such as dialkyl phthalate of the type disclosed in U.S. Pat. No. 3,905,934. Other dialkyl esters include dimethyl glutarate; dimethyl adipate; dimethyl succinate; and mixtures of such esters.

The binder compositions are preferably made available as a three component system with the phenolic resin component as one component, the isocyanate component as another component, and the catalyst as the third component. Usually, the phenolic resin component and catalyst are first mixed with sand. Then the isocyanate component is added and mixed with the sand. Although not preferred, the catalyst and can be added to the polyisocyanate component. Methods of distributing the binder on the aggregate particles are well-known to those skilled in the art.

When preparing an ordinary sand-type foundry shape, the aggregate employed has a particle size large enough to provide sufficient porosity in the foundry shape to permit escape of volatiles from the shape during the casting operation. The term "ordinary sandtype foundry shapes," as used herein, refers to foundry shapes which have sufficient porosity to permit escape of volatiles from them during the casting operation.

The preferred aggregate employed for ordinary foundry shapes is silica wherein at least about 70 weight percent and preferably at least about 85 weight percent of the sand is silica. Other suitable aggregate materials include zircon, olivine, aluminosilicate, sand, chromite sand, and the like. Although the aggregate employed is preferably dry, it can contain minor amounts of moisture.

In molding compositions, the aggregate constitutes the major constituent and the binder constitutes a relatively minor amount. In ordinary sand type foundry applications, the amount of binder is generally no greater than about 10% by weight and frequently within the range of about 0.5% to about 7% by weight based upon the weight of the aggregate. Most often, the binder content ranges from about 0.6% to about 5% by weight based upon the weight of the aggregate in ordinary sand-type foundry shapes.

The liquid anine catalyst used in the binder is a base having a $pK_b$ value in the range of about 7 to about 11. The $pK_b$ value is the negative logarithm of the dissociation constant of the base and is a well-known measure of the basicity of a basic material. The higher this number is, the weaker the base. Preferred materials are heterocyclic compounds containing at least one nitrogen atom in the ring structure. Specific examples of bases which have $pK_b$ values within the necessary range include 4-alkyl pyridines wherein the alkyl group has from one to four carbon atoms, isoquinoline, arylpyridines such as phenyl pyfidine, pyridine, acridine, 2-methoxypyridine, pyridazine, 3-chloro pyridine, quinoline, N-methyl imidazole, 4,4-dipyridine, phenylpropyl pyridine, 1-methylbenzimidazole, and 1,4-thiazine.

In general the active catalyst level used in the subject no-bake binders is from two to three times greater than the amount used in a no-bake binder which does not contain a hydrofluoric acid. Obviously, the amount will vary depending upon the pKb value of the catalyst. Since catalysts having a higher $pK_b$ value are less reactive, then more catalyst should be used than if a catalyst having a lower pKb value is used. Generally, the active catalyst level is such that the weight ratio of active catalyst to active hydrofluoric acid is about 20:1 to 1:1, preferably 10:1 to 1:1. In terms of the amount of active catalyst by weight used in the binder, this amount is typically at least 0.75 weight percent based upon the weight of the phenolic resin component, preferably from 1.25 to 5.0 weight percent, most preferably from 1.25 to 3.0 weight percent. The higher levels of catalyst are needed to obtain tensile strengths for cores and molds of at least 150 psi. at a binder level of less than 1.25 weight percent based upon the weight of sand, preferably at a binder level of 1.00 to 1.25 weight percent, when the tensile strength is measured 30 minutes after the core or mold is removed from the pattern. The catalyst is preferably used in amount to result in a worktime from about 3 to 10 minutes and a striptime from about 4 to 12 minutes for the foundry mix.

ABBREVIATIONS

The following abbreviations will be used in the examples:

| | |
|---|---|
| BOS | based on sand. |
| HF | hydrofluoric acid at about 49.0% concentration in water. |
| IC | isocyanate component, comprising about 65 to 75% by weight of polymethylene polyphenyl isocyanate, having an average functionality of 2.6 and 3.2, and about 25 to 35% by weight of an aromatic solvent. |
| RC | phenolic resin component comprising about 60 to 65 percent by weight of a phenolic resole benzylic ether resin such as that described in U.S. Pat. No. 3,485,797 and from 35 to 40 percent by weight of a solvent comprising a mixture of an aromatic solvent and an ester solvent. |
| SIL | A-1160 ureido silane. |
| ST | striptime is the time interval between when the shaping of the mix in the pattern is completed and the time and when the shaped mixture can no longer be effectively removed from the pattern, and is determined by the green hardness tester. |
| TA | a 25 weight percent solution of a liquid tertiary amine catalyst having a $pK_b$ value of 8.14, known as 4-phenyl propyl pyridine, in an aromatic solvent. |
| WT | worktime is the time interval between when mixing begins and when the mixture can no longer be effectively shaped to fill a mold or core and is determined by the green hardness tester. |
| WT/ST | worktime/striptime. |
| Wedron 540 | silica sand. |
| 30 minute tensiles | ensile strength of a core or mold measured 30 minutes after removing the core or mold from the pattern. |

EXAMPLES

The examples below will illustrate specific embodiments of the invention. In all of the examples, the binders were used consisted of 100 parts of RC as the Part I and 100 parts of IC as the Part II. The HF and SIL levels, whose levels were all based on the Part I, were added into the Part I at room temperature and mixed well.

A sand mix was prepared by mixing 4000 parts by weight of Manley 1L-5W sand with a binder at a level of 1.25% binder BOS and at a mix ratio of Part I/Part II of 55:45. The Part I and catalyst were first mixed with the sand for about 2 minutes. Then the Part II component was added into the mixture for an additional 2 minutes mixing.

Test shapes (dogbone shapes) were prepared by phenolic urethane no-bake process to evaluate the sand tensile development. Testing the sand tensile strength of the dog bone shapes enables one to predict how the mixture of sand and binder will work in actual foundry facilities. The dog-bone shapes were stored at 0.5 hour, 1.0 hour, 3 hours and 24 hours in a constant temperature room at relative humidity of 50% and a temperature of 25° C. before measuring their tensile strengths. Unless otherwise specified, the tensile strengths were also measured for the dogbone shapes after storing them 24 hours at a relative humidity (RH) of 100%.

The Controls are labeled with letters and do not contain either hydrofluoric acid, or a silane, or both.

The first group of experiments were controls and did not contain SIL, but were carried out with and without HF. The results are shown in Table I.

TABLE I

| | | | (Sand Tensile Strength Development) (Effect of HF) | | | | | | |
|---|---|---|---|---|---|---|---|---|---|
| Control | HF | SIL | TA | WT/ST | 30 min | 1 hrs | 3 hrs | 24 hrs | 24 hr @ 100% RH |
| A | 0 | 0 | 3.0 | 3.0/4.3 | 174 | 212 | 245 | 331 | 65 |
| B | 0.3 | 0 | 3.0 | 10.0/13.0 | 112 | 162 | 212 | 341 | 156 |

The addition of the BF increases resistance to humidity, but also shows a potentially undesirable increase in WT/ST.

The second group of experiments did not contain a HF, but were carried out with and without SL. The results are shown in Table II.

TABLE II

| | | | (Sand Tensile Strength Development) (Effect of SIL) | | | | | | |
|---|---|---|---|---|---|---|---|---|---|
| Control | HF | SIL | TA | WT/ST | 30 min | 1 hrs | 3 hrs | 24 hrs | 24 hr @ 100% RH |
| C | 0 | 0 | 3.0 | 5.5/6.5 | 158 | 196 | 244 | 314 | 68 |
| D | 0 | 0.5 | 3.0 | 6.0/7.3 | 145 | 200 | 217 | 324 | 200 |

The addition of SIL increases resistance to humidity and also shows an increase in WT/ST. The data in Table II also indicates that there is some decrease in 30 minute tensile strengths when SEL alone is used.

The next experiments, other than the Controls, contained both a silane and HF. The results are shown in Table III.

TABLE III

| | | | (Sand Tensile Strength Development) (Effect of Silane and HF) | | | | | | |
|---|---|---|---|---|---|---|---|---|---|
| Example | HF | SIL | TA | WT/ST | 30 min | 1 hrs | 3 hrs | 24 hrs | 24 hr @ 100% RH |
| E | 0 | 0 | 3.0 | 4.7/6.0 | 161 | 200 | 233 | 292 | 97 |
| 1 | 0.3 | 0.5 | 3.0 | 10.5/12.0 | 126 | 195 | 242 | 360 | 316 |
| 2 | 0.15 | 0.3 | 3.0 | 8.8/10.0 | 141 | 196 | 229 | 282 | 295 |
| F | 0.3 | 0.0 | 3.0 | 8.8/10.3 | 135 | 170 | 208 | 295 | 167 |

The data in Table III indicate that the addition of HF/SIL to the no-bake binder, using the same catalyst level, slowed the cure speed, lowered the initial sand tensile strengths, and dramatically improved the humidity resistance, when compared to the control without any HF or silane. Thus Examples 1 and 2 had longer WT/ST, lower 30 minute tensile strengths, but significantly better humidity resistance than Control E or F. Note also that the humidity resistance of Control F without a silane was not as good as Examples 1 or 2.

The next experiments relate to determining the effect of increasing the levels of the TA catalyst while retaining the same level of HF and silane. Table IV sets forth the results.

TABLE IV (Sand Tensile Strength Development)
(Effect of Catalyst Level)

| Example | HF | SW | TA | WT/ST | 30 min | 1 hrs | 3 hrs | 24 hrs | 24 hr @ 100% RH |
|---|---|---|---|---|---|---|---|---|---|
| G | 0 | 0 | 3.0 | 5.0/6.3 | 167 | 220 | 244 | 310 | 87 |
| 3 | 0.3 | 0.5 | 4.0 | 8.8/10.0 | 166 | 246 | 267 | 383 | 296 |
| 4 | 0.3 | 0.5 | 6.5 | 5.3/6.3 | 184 | 206 | 266 | 368 | 230 |

Table IV shows that if the catalyst level is increased, the cure speed and WT/ST are more similar to the control, the 30 minute tensile strengths are better than the control, and the dramatic improvement of humidity resistance is retained. Thus the binders used in Examples 3 and 4 binders provide cores with higher 30 minute tensile strengths as well as better humidity resistance than Control G. Apparently, the combination of HF/A-1160 coupled with higher levels of catalyst give the no-bake binder the advantages of better initial tensile strength and much improved humidity resistance. These advantages are highly desirable in the foundry applications because they allow for faster demolding (thus higher productivity), as well as fewer broken molds due to the higher initial tensile strengths and overall improved tensile strength.

The next experiments also relate to determining the effect of increasing the catalyst level while also varying the level of HF and SIL. Table V sets forth the results.

TABLE V (Sand Tensile Strengh Development)
(Effect of HF/Catalyst Level)

| Example | HF | SIL | TA | WT/ST | 30 min | 1 hrs | 3 hrs | 24 hrs | 24 hr @ 100% RH |
|---|---|---|---|---|---|---|---|---|---|
| H | 0 | 0 | 3.0 | 5.0/6.3 | 152 | 183 | 247 | 240 | 80 |
| 5 | 0.15 | 0.3 | 4.0 | 6.3/7.5 | 168 | 205 | 241 | 301 | 257 |
| 8 | 0.15 | 0.3 | 5.0 | 5.5/6.5 | 178 | 207 | 273 | 308 | 239 |
| 7 | 0.1 | 0.3 | 3.5 | 6.3/7.5 | 155 | 208 | 259 | 329 | 312 |
| 6 | 0.1 | 0.3 | 4.5 | 5.0/6.3 | 182 | 211 | 274 | 336 | 289 |

The Examples of Table V show again that initial tensile strength is increased by increasing the catalyst level even when lower levels of HF are used.

We claim:

1. A foundry mix comprising an aggregate and a binder in an amount of up to about 10% by weight, based upon the weight of the aggregate, wherein said binder comprises:

(a) a phenolic resole resin component comprising;
  (1) a phenolic resole resin;
  (2) from 0.05 weight percent to 0.15 weight percent of hydrofluoric acid, and
  (3) from 0.1 weight percent to 0.5 weight percent of a silane;
  where said weight percents are based upon the weight percent of the phenolic resin component;

(b) a polyisocyanate component comprising an organic polyisocyanate; and (c) from 1.25 to 5.0 parts of an active amount of a liquid tertiary amine catalyst wherein said liquid tertiary amine catalyst is part of component (b) or a separate component, and said weight percent of the liquid tertiary amine catalyst is a upon the weight percent of percent of the phenolic resin component.

2. The foundry mix of claim 1 wherein the phenolic resole resin of the phenolic resin component comprises a phenolic resole resin prepared by reacting an aldehyde with a phenol such that the molar ratio of aldehyde to phenol is from 1.1:1.0 to 3.0:1.0.

3. The foundry mix of claim 2 wherein said phenolic resole resin is prepared with a divalent metal catalyst.

4. The foundry mix of claim 3 wherein the phenol used to prepare the phenolic resole resin is selected from the group consisting of phenol, o-cresol, m-cresol, and mixtures thereof.

5. The foundry mix of claim 4 wherein the polyurethane-forming process composition has a ratio of hydroxyl groups of the phenolic resin to isocyanate groups of the polyisocyanate of from about 1.25:1.00 to 1.00:1.25.

6. The foundry mix of claim 5 wherein the silane is a ureido silane.

7. The foundry mix of claim 6 where the active amount of liquid tertiary amine catalyst is from 1.50 to 5.0 weight percent based upon the weight of the phenolic resin component.

8. The foundry mix of claim 7 wherein the phenolic resin component contains a solvent in which the phenolic resole resin is soluble.

9. A no-bake process for the fabrication of foundry shapes which comprises:

(A) forming a foundry mix comprising an aggregate and a binder in an amount of up to about 10% by weight, based upon the weight of the aggregate, wherein said binder comprises:
  (a) a phenolic resole resin component comprising;
    (1) a phenolic resole resin;
    (2) from 0.05 weight percent to 0.15 weight percent of hydrofluoric acid, and
    (3) from 0.1 weight percent to 0.5 weight percent of a silane;
    where said weight percents are based upon the weight percent of the phenolic resin component;
  (b) a polyisocyanate component comprising an organic polyisocyanate; and (c) from 1.25 to 5.0 parts of an active amount of a liquid tertiary amine catalyst wherein said liquid tertiary amine catalyst is part of component (b) or a separate component, and said weight percent of the liquid tertiary amine catalyst is based upon the weight percent of the phenolic resin component;

(B) introducing the foundry mix obtained from step A into a pattern;

(C) allowing the foundry mix shape to harden in the pattern until it becomes self-supporting; and (D) thereafter removing the shaped foundry mix of step C from the pattern and allowing to further cure, thereby obtaining a hard, solid, cured foundry shape.

10. The no-bake process of claim 9 wherein the phenolic resole resin of the phenolic resin component comprises a phenolic resole resin prepared by reacting an aldehyde with a phenol such that the molar ratio of aldehyde to phenol is from 1.1:1.0 to 3.0:1.0.

11. The no-bake process of claim 10 wherein said phenolic resole resin is prepared with a divalent metal catalyst.

12. The no-bake process of claim 11 herein the phenol used to prepare the phenolic resole resin is selected from the group consisting of phenol, o-cresol, m-cresol, and mixtures thereof.

13. The no-bake process of claim 12 wherein the polyurethane-forming process composition has a ratio of hydroxyl groups of the phenolic resin to isocyanate groups of the polyisocyanate of from about 1.25:1.00 to 1.00:1.25.

14. The no-bake process of claim 13 wherein the silane is a ureido silane.

15. The no-bake process of claim 14 where the active amount of liquid tertiary amine catalyst is from 1.50 to 5.0 weight percent based upon the weight of the phenolic resin component.

16. The no-bake process of claim 15 wherein the phenolic resin component contains a solvent in which the phenolic resole resin is soluble.

* * * * *